United States Patent [19]

Hartle

[11] 4,036,605

[45] July 19, 1977

[54] CHELATES OF CERIUM (IV), THEIR PREPARATION AND GASOLINE CONTAINING SAID CHELATES

[75] Inventor: Robert J. Hartle, Gibsonia, Pa.

[73] Assignee: Gulf Research & Development Company, Pittsburgh, Pa.

[21] Appl. No.: 368,566

[22] Filed: June 11, 1973

Related U.S. Application Data

[62] Division of Ser. No. 177,148, Sept. 1, 1971, abandoned.

[51] Int. Cl.[2] ..... C10L 1/30

[52] U.S. Cl. ..... 44/68

[58] Field of Search ..... 44/68

[56] References Cited

U.S. PATENT DOCUMENTS

| | | | |
|---|---|---|---|
| 2,086,775 | 7/1937 | Lyons et al. | 44/68 |
| 2,926,184 | 2/1960 | Irish et al. | 44/68 |
| 3,003,859 | 10/1961 | Irish et al. | 44/68 |
| 3,157,682 | 11/1964 | Ramsden | 44/68 |

*Primary Examiner*—Daniel E. Wyman
*Assistant Examiner*—Y. Harris Smith, Mrs.

[57] ABSTRACT

A gasoline motor fuel having improved antiknock characteristics is obtained by incorporating a novel chelate of cerium (IV) in the gasoline. Examples of the novel chelates of cerium (IV) include ps
ceric 2,4-hexanedionate
ceric 3,5-octanedionate
ceric 2,2-dimethyl-3,5-heptanedionate
ceric 2,6-dimethyl-3,5-heptanedionate
ceric 2,2,6,6-tetramethyl-3,5-heptanedionate The chelates of cerium (IV) are prepared by a novel oxidative ligand exchange reaction between cerous acetylacetonate and a $\beta$-diketone.

13 Claims, No Drawings

CHELATES OF CERIUM (IV), THEIR PREPARATION AND GASOLINE CONTAINING SAID CHELATES

This is a division of application Ser. No. 177,148, filed Sept. 1, 1971, now abandoned.

This invention relates to novel chelates of cerium (IV), to a novel process for their preparation and to gasoline fuel compositions containing said chelates of cerium (IV).

It has long been recognized that for greater economy with respect to fuel requirement and greater efficiency in the operation of a gasoline powered, spark ignition engine, high compression ratios are desired, i.e., compression ratios in the order of 8.5:1 to 10.5:1. In order to obtain smooth engine operation at these high compression ratios under various driving conditions it is necessary to employ a fuel having high octane numbers as determined by both the motor method (ASTM D2700) and the research method (ASTM D2699).

In order to obtain fuels having both high motor and high research octane numbers the petroleum industry has developed numerous petroleum hydrocarbon conversion processes among which may be mentioned cracking, alkylation, aromatization, cyclization, isomerization, hydrogenation, dehydrogenation, hydroisomerization, polymerization, hydrodesulfurization, reforming, hydroforming, polyforming, "Platforming" and combinations of two or more of such processes. These processes produce hydrocarbons boiling in the gasoline boiling range which have engine performance characteristics markedly superior to the charge stock and to comparable boiling hydrocarbons found in straight-run gasolines. In general, straight-run gasolines are more paraffinic and less olefinic and aromatic than gasolines obtained, for example, by a cracking process. Straight-run gasolines generally do not give the high motor and research octane numbers required for smooth performance in present day engines. The base fuels used in the compositions of the present invention are, therefore, fuels or a blend of fuels obtained by one or more of the above-mentioned hydrocarbon conversion processes. However, a small amount of straight-run gasoline, in some instances, may be blended with the fuels obtained by a conversion process.

While octane ratings of fuels can be improved still further by additional refining and blending techniques, such additional processing is costly and heretofore has been considered economically unsound. Therefore, to improve the octane ratings of fuels obtained by one or more of the various conversion processes, the petroleum industry has resorted to the use of an antiknock agent such as tetraethyllead. While the addition of tetraethyllead to gasolines obtained by one or more of the above conversion processes improves the motor and research octane numbers of the gasolines, the resulting fuels have certain disadvantages arising from the presence of the lead. One of the objections to the use of gasolines containing tetraethyllead as fuels for automotive engines arises from the presence of lead compounds, i.e., oxides, sulfates, phosphates, bromides and chlorides of lead in the exhaust gas from the engine.

As the number of automobiles utilizing leaded-gasolines increases, the amount of lead compounds emitted into the atmosphere also increases. While there is no proof that atmospheric contamination due to the presence of lead compounds in automobile exhaust gas presents a serious health problem at the present time, increased attention is being directed to the development of gasoline fuel compositions which contain little or no compounds of lead. In addition, attention is being directed to methods of reducing unburned hydrocarbons and carbon monoxide in the exhaust gas from gasoline-powered engines.

The automobile industry is currently investigating various devices for use in internal combustion engines to reduce the amount of hydrocarbons and carbon monoxide in the exhaust gases from such engines. One such device comprises a catalytic converter which is placed in the exhaust system of the engine. When exhaust gases pass through this device unburned hydrocarbons are oxidized and carbon monoxide is converted to carbon dioxide. Cerium oxide is one of the catalysts which has been used in such catalytic converters.

While catalytic converters are effective when first installed, the catalyst in such converters is gradually poisoned particularly by compounds of lead when the gasoline originally contains an alkyllead antiknock agent. Naturally, when the catalyst becomes poisoned, the converters are no longer effective for their intended purpose.

In accordance with the present invention, an improved gasoline fuel composition is provided wherein a novel chelate of cerium (IV) is utilized as an antiknock agent. When a gasoline containing said chelate of cerium (IV) is burned in the combustion chamber of a spark ignition engine, the exhaust gases from said engine contain some oxides of cerium together with other products of combustion. The oxides of cerium, unlike the oxides of lead, do not poison a cerium oxide catalyst in a catalytic converter containing this catalyst, but, instead, prolong the life of such a catalyst. Likewise, the exhaust gases from an engine powered by a fuel containing a chelate of cerium (IV) instead of an alkyllead compound have no volatile compounds of lead therein.

The novel chelates of cerium (IV) of the present invention are represented by the following general formula

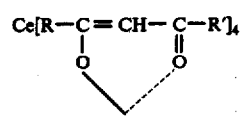

where R and R′ are selected from the group consisting of alkyl, aryl, aralkyl, alkaryl and cycloalkyl radicals containing from 1 to 12 carbon atoms and the sum of the carbon atoms in said radicals is 3 to 24. Examples of such radicals are methyl, ethyl, propyl, isopropyl, n-butyl, sec-butyl, tertiary butyl, n-amyl, tertiary amyl, n-hexyl, n-heptyl, triethylmethyl, n-octyl, isooctyl, nonyl, decyl, undecyl, dodecyl, phenyl, naphthyl, benzyl, phenethyl, tolyl, xylyl, methylnaphthyl, ethylphenyl, propylphenyl, butylphenyl, amylphenyl, hexylphenyl, diethylphenyl, dipropylphenyl, trimethylphenyl, triethylphenyl, cyclopentyl, cyclohexyl and cyclooctyl.

A specific example of a preferred compound of the invention where R and R′ are tertiary butyl groups is ceric 2,2,6,6-tetramethyl-3,5-heptanedionate. Specific examples of other compounds of the invention are ceric 2,4-hexanedionate
ceric 2,4-heptanedionate
ceric 2,4-octanedionate
ceric 3,5-heptanedionate ceric 3,5-octanedionate
ceric 4,6-nonanedionate
ceric 4,6-decanedionate
ceric 5,7-undecanedionate
ceric 6,8-tridecanedionate
ceric 5,7-tetradecanedionate
ceric 7,9-pentadecanedionate
ceric 7,9-hexadecanedionate
ceric 8,10-heptadecanedionate
ceric 8,10-octadecanedionate
ceric 9,11-nonadecanedionate
ceric 9,11-eicosanedionate
ceric 10,12-heneicosanedionate
ceric 10,12-docosanedionate
ceric 11,13-tricosanedionate
ceric 11,13-tetracosanedionate
ceric 12,14-pentacosanedionate
ceric 12,14-hexacosanedionate
ceric 13,15-heptacosanedionate
ceric 2,2-dimethyl-3,5-hexanedionate
ceric 2,2-dimethyl-3,5-heptanedionate
ceric 2,2-dimethyl-3,5-octanedionate
ceric 2,2-dimethyl-3,5-nonanedionate
ceric 2,6-dimethyl-3,5-heptanedionate
ceric 2,7-dimethyl-3,5-octanedionate
ceric 3,3,7,7-tetraethyl-4,6-nonanedionate
ceric 1-phenyl-1,3-butanedionate
ceric 1-phenyl-1,3-heptanedionate
ceric 1-phenyl-1,3-undecanedionate
ceric 1-phenyl-1,3-pentadecanedionate
ceric 1-naphthyl-1,3-butanedionate
ceric 1-benzyl-1,3-butanedionate
ceric 1-tolyl-1,3-butanedionate
ceric 1-cyclohexyl-1,3-butanedionate
ceric 1,3-diphenyl-1,3-propanedionate
ceric 1,3-dinaphthyl-1,3-propanedionate
ceric 1,3-dibenzyl-1,3-propanedionate
ceric 1,3-ditolyl-1,3-propanedionate
ceric 1,3-dicyclohexyl-1,3-propanedionate The chelates of cerium (IV) of this invention are in general, liquid or solid compounds, the solids melting at low or moderate temperatures. They are stable at ordinary temperatures and can be readily prepared and stored without special precautions for future use.

The compounds of the invention are prepared by a novel procedure which comprises an oxidative ligand exchange reaction wherein cerous acetylacetonate is reacted with a $\beta$-diketone as illustrated by the following equation:

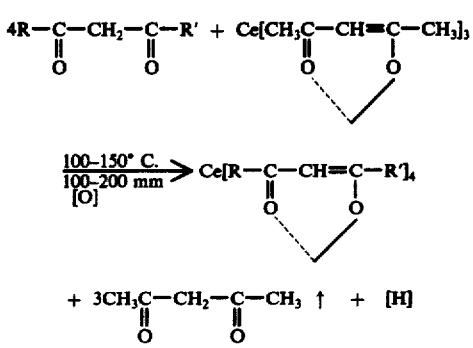

where R and R′ are hydrocarbon radicals as indicated hereinabove. The R and R′ radicals can either be the same or different radicals except that at least one of said radicals must contain at least two carbon atoms. While I do not wish to be bound by any theory with respect to the means by which trivalent cerium is converted to tetravalent cerium in the above reaction, it is possible that atmospheric oxygen might participate in the oxidation since air is not excluded from contact with the reactants. It is possible, however, that the $\beta$-diketone serves as an oxidant.

The amount of the $\beta$-diketone employed in the reaction is at least sufficient to react with all of the cerous acetylacetonate to form the chelate of cerium (IV). While I can use about 4 to about 8 moles of the $\beta$-diketone per mole of cerous acetylacetonate, I prefer to employ only that amount or a slight excess of that amount of the $\beta$-diketone which is stoichiometrically required to react with the cerous acetylacetonate. Thus, in a preferred embodiment of the invention, I employ about 4 moles of the $\beta$-diketone per mole of cerous acetylacetonate. Any excess of unreacted $\beta$-diketone can be removed from the reaction mass with a suitable solvent such as hexane.

The reaction is carried out at a temperature within the range of about 100° to about 150° C., generally between about 120° and about 130° C. The reaction can be conducted entirely at atmospheric pressure. I prefer, however, to initiate the reaction at atmospheric pressure and thereafter reduce the pressure below atmospheric pressure, for example, a pressure of about 100 to about 200 mm of mercury. Completion of the reaction is aided by removing the acetylacetone substantially as fast as it is formed. Heating the reaction mass is continued until the reaction mixture thickens and there is a decided change in color indicating conversion of the cerous salt to the ceric salt. Purification of the product is accomplished by recrystallization from a suitable solvent such as hexane.

The process of the invention is applicable to $\beta$-diketones containing at least 6 carbon atoms. Cerous acetylacetonate and the $\beta$-diketones used in preparing the compounds of the present invention either are available commercially or can be readily prepared so that these reactants and their preparation do not constitute any portion of the invention. Cerous acetylacetonate is offered for sale by Research Organic/Inorganic Chemical Co. of Sun Valley, Calif., and K&K of Plainview, N.Y., and can be prepared by the method disclosed by Stites et al. *J. Am. Chem. Soc.*, 70, 3142–3143 (1948). Examples of the $\beta$-diketones which are used in the process of the present invention are 2,4-hexanedione
2,4-heptanedione
2,4-octanedione
3,5-heptanedione
3,5-octanedione
3,5-nonanedione
4,6-nonanedione
4,6-decanedione
5,7-undecanedione
5,7-dodecanedione
6,8-tridecanedione
5,7-tetradecanedione
7,9-pentadecanedione
7,9-hexadecanedione
8,10-heptadecanedione
8,10-octadecanedione
9,11-nonadecanedione
9,11-eicosanedione
10,12-heneicosanedione 10,12-docosanedione
11,13-tricosanedione
11,13-tetracosanedione
12,14-pentacosanedione
12,14-hexacosanedione
13,15-heptacosanedione
2,2-dimethyl-3,5-hexanedione
2,2-dimethyl-3,5-heptanedione
2,2-dimethyl-3,5-octanedione
2,2-dimethyl-3,5-nonanedione
2,6-dimethyl-3,5-heptanedione
2,7-dimethyl-3,5-octanedione
2,2,6,6-tetramethyl-3,5-heptanedione
1-phenyl-1,3-butanedione
1-phenyl-1,3-heptanedione
1-phenyl-1,3-undecanedione
1-phenyl-1,3-pentadecanedione
1-naphthyl-1,3-butanedione
1-benzyl-1,3-butanedione
1-tolyl-1,3-butanedione
1-cyclohexyl-1,3-butanedione
1,3-diphenyl-1,3-propanedione (dibenzoylmethane)
1,3-dinaphthyl-1,3-propanedione
1,3-dibenzyl-1,3-propanedione
1,3-ditolyl-1,3-propanedione
1,3-dicyclohexyl-1,3-propanedione The following example illustrates a specific procedure by which compounds of the invention can be prepared. In the following example, ceric 2,2,6,6-tetramethyl-3,5-heptanedionate was prepared by reacting cerous acetylacetonate with 2,2,6,6-tetramethyl-3,5-heptanedione (dipivaloylmethane).

In this example dipivaloylmethane was prepared following the procedure of Hammond [J. Org. Chem. 27, 1036 (1962)]. Methyl pivalate (90 grams, 0.8 mole) and sodium hydride (126 grams of 57% dispersion in oil, 3.0 mole) were added to 1 liter of 1,2-dimethoxyethane (dried over sodium). The mixture was stirred and brought to reflux. Pinacolone (80 grams, 0.8 mole) in 100 ml of dimethoxyethane was added dropwise over a 2-hour period after which refluxing was continued for an additional 30 minutes. Hydrogen was liberated during this time. The reaction mixture was cooled and concentrated hydrochloric acid was added dropwise over a 1-hour period or until the mixture was strongly acidic (about 200 grams of concentrated acid). The resulting mixture was poured into 2 liters of water. Low boiling petroleum ether (500 ml) was added and the aqueous phase was removed. The organic layer was washed with five 100 ml portions of water and then dried over magnesium sulfate. Solvent was removed on the steam bath and the residual liquid was distilled through an efficient column. Dipivaloylmethane was recovered by distillation. The dipivaloylmethane distilled at 106°–108° C/36 mm; $n_D^{25}=1.455$. The yield was 52%.

11.0 grams (0.06 mole) of dipivaloylmethane obtained in accordance with the above procedure was admixed at atmospheric pressure with 6.0 grams (0.014 mole) of cerous acetylacetonate. The mixture was then stirred while heating to 120° C. After mixing at this temperature for about 15 minutes, the pressure was reduced to 160 mm of mercury. Heating was continued and acetylacetone was removed as formed through a distillation assembly. After about 30 minutes, the reaction mixture thickened and changed from light yellow to deep red in color. It is considered that this color change indicates conversion of trivalent to tetravalent cerium. Heating under reduced pressure was continued for a total of five hours with occasional stirring of the semisolid mass. The mixture was then cooled to about 30° C. and extracted with boiling hexane. The hexane solution was then stripped to remove solvent and excess dipivaloylmethane. The residual solid was recrystallized from hexane to yield 4.5 g of large black crystals. In a finely divided state, the product had a deep maroon color. The product melted at 195° C. with decomposition. Electron spin resonance analysis showed no evidence of trivalent cerium. Elemental analysis of the product showed a favorable comparison to the theoretical analysis for ceric 2,2,6,6-tetramethyl-3,5-heptanedionate as follows:

| Ultimate analysis | Found for product | Calculated for ceric 2,2,6,6-tetramethyl-3,5-heptanedionate ($C_{44}H_{76}O_8Ce$) |
|---|---|---|
| Carbon, percent | 60.80 | 60.55 |
| Hydrogen, percent | 8.62 | 8.71 |
| Cerium, percent | 16.28 | 16.05 |

The foregoing example is illustrative only. Other chelates of cerium (IV) can be prepared in a similar manner by substitution of other $\beta$-diketones as disclosed hereinabove in the same or equivalent proportions as used in the foregoing specific embodiment. For example, ceric 2,4-hexanedionate can be prepared utilizing the above procedure by replacing 2,2,6,6-tetramethyl-3,5-heptanedione with 2,4-hexanedione. Ceric 3,5-octanedionate can be prepared from 3,5-octanedione and cerous acetylacetonate. Ceric 2,2-dimethyl-3,5-heptanedionate can be prepared from 2,2-dimethyl-3,5-heptanedione and cerous acetylacetonate. Ceric 2,6-dimethyl-3,5-heptanedionate can be prepared from 2,6-dimethyl-3,5-heptanedione and cerous acetylacetonate. In each instance the conversion temperature is reached when a pronounced color change referred to in the above example occurs.

The chelates of cerium IV employed in the compositions of the present invention also can be prepared by alternate methods known and reported in the literature. See Berg et al. *Anal. Chem. Acta.*, 40, 101–113, (1968) which discloses the preparation of cerric 2,2,6,6-tetramethyl-3,5-heptanedionate.

The novel chelates of cerium (IV) of this invention are particularly useful as antiknock agents in gasoline fuel compositions for spark ignition engines. For example, I have found that the addition of a small amount of ceric 2,2,6,6-tetramethyl-3,5-heptanedionate to a gasoline greatly improves its antiknock characteristic. The amount of the chelate of cerium (IV) employed depends upon the particular chelate as well as the base gasoline to which the chelate is added. Ordinarily, the chelate is added in an amount sufficient to incorporate about 0.1 to about 3.0 grams of cerium per gallon of gasoline. Excellent results have been obtained when the chelate of cerium (IV) was employed in gasoline in amounts sufficient to incorporate about 0.5 to about 2.0 grams of cerium per gallon of gasoline. While amounts in excess of 3.0 grams of cerium per gallon of gasoline can be employed, such larger amounts do not give significantly improved antiknock characteristics. Therefore, for economic reasons, I prefer to use no more of the cerium (IV) chelate than is necessary to give the optimum improvement, that is, a small amount sufficient to improve the antiknock characteristics of the gasoline.

The chelates of cerium (IV) of this invention can be incorporated in the base gasoline fuel composition in any suitable manner. Thus, they can be added as such to gasoline or they can be added in the form of dispersions or solutions in solvents such as butanol, isopropanol, ethanol, methanol, benzene, toluene, heptane, kerosene, gasoline, mineral lubricating oil, or the like. If desired, the herein disclosed chelates of cerium (IV) can be incorporated in gasoline fuel compositions in admixture with other gasoline improvement agents including upper cylinder lubricants, corrosion and oxidation inhibitors, ignition control agents, metal deactivators, dehazing agents, anti-rust agents, deicing agents, other antiknock agents, dyes and the like, and the invention specifically includes gasoline compositions containing such additives.

The gasoline fuel compositions to which the chelates of cerium (IV) are added and in which the chelates serve as antiknock agents includes substantially all grades of gasoline presently being employed in internal combustion spark ignition engines. Such gasolines comprise a mixture of hydrocarbons which can be obtained by at least one of the petroleum conversion processes including cracking, alkylation, aromatization, cyclization, isomerization, hydrogenation, dehydrogenation, hydroisomerization, polymerization, hydroforming, polyforming, "Platforming" and combinations of two or more such processes, as well as by the Fischer-Tropsch and related processes. Thus, the term "gasoline" is used herein in its conventional sense to include hydrocarbons boiling in the gasoline boiling range. While current straight-run gasoline has octane numbers too low to qualify as the sole hydrocarbon component of gasoline fuel compositions having desirably high octane numbers for current engines, a small amount of straight-run gasoline can be blended with the hydrocarbon mixture obtained by one or more of the designated conversion processes. A preferred gasoline fuel composition comprises a blend of hydrocarbons obtained by catalytic cracking, "Platforming" and alkylation processes.

In order to illustrate the beneficial effect of a chelate of cerium (IV) on the octane number of gasoline, gasoline fuel compositions were prepared from a full boiling premium gasoline (84.7 O.N.) and a primary reference fuel (76.9 O.N.). The make-up of the fuels evaluated and the test results are shown in Table I.

TABLE I

| Fuel Composition | A | B | C | D | E | F | G | H |
|---|---|---|---|---|---|---|---|---|
| Base Gasoline A | 100 | — | 100 | 100 | 100 | 100 | 100 | — |
| Base Gasoline B | — | 100 | — | — | — | — | — | 100 |
| Added | | | | | | | | |
| Ceric 2,2,6,6-tetramethyl-3,5-heptanedionate, g/gallon | — | — | 1.98 | 3.9 | 6.0 | 12.0 | 18.0 | 3.0 |
| Expressed as cerium, g Ce/gallon | — | — | 0.33 | 0.65 | 1.0 | 2.0 | 3.0 | 0.5 |
| Knock Ratings | | | | | | | | |
| Motor Method, D2700 | 84.7 | 76.9 | 85.9 | 86.4 | 87.3 | 87.9 | 86.7 | 83.4 |
| Research Method, D2699 | 92.4 | 77.2 | 93.4 | 93.9 | 95.3 | 95.8 | 96.1 | 83.2 |

The data in Table I clearly demonstrate the improved octane ratings of gasolines to which a chelate of cerium (IV) is added. While optimum octane number improvement according to the Motor Method is obtained at about 12 grams of the cerium (IV) chelate per gallon of gasoline (2 g Ce/gallon), further improvement in the octane number by the Research Method is obtained with 18.0 grams of the cerium (IV) chelate per gallon of gasoline (3 g Ce/gallon).

Specific examples of other gasoline motor fuel compositions within the scope of the invention are set forth in Table II.

TABLE II

| Fuel Composition | I | J | K | L |
|---|---|---|---|---|
| Base Gasoline A | 100 | — | 100 | — |
| Base Gasoline B | — | 100 | — | 100 |
| Added | | | | |
| Ceric 2,4-hexanedionate g Ce/gallon | 0.5 | — | — | — |
| Ceric 3,5-octanedionate g Ce/gallon | — | 1.0 | — | — |
| Ceric 2,2-dimethyl-3,5-heptanedionate g Ce/gallon | — | — | 2.0 | — |
| Ceric 2,6-dimethyl-3,5-heptanedionate g Ce/gallon | — | — | — | 3.0 |

While my invention has been described above with reference to various specific examples and embodiments, it will be understood that the invention is not limited to such examples and embodiments and may be variously practiced within the scope of the claims hereinafter made.

I claim:

1. A gasoline motor fuel composition comprising a major amount of gasoline and a small amount, sufficient to improve the antiknock characteristics of said gasoline, of a chelate of cerium (IV) represented by the general formula

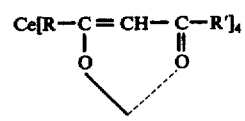

where R and R′ are selected from the group consisting of alkyl, aryl, aralkyl, alkaryl and cycloalkyl radicals containing from 1 to 12 carbon atoms and the sum of the carbon atoms in said radicals is 3 to 24.

2. The gasoline motor fuel composition of claim 1 wherein the chelate of cerium (IV) is present in an amount sufficient to incorporate about 0.1 to about 3.0 grams of cerium per gallon of gasoline.

3. The gasoline motor fuel composition of claim 1 wherein the chelate of cerium (IV) is ceric 2,4-hexanedionate.

4. The gasoline motor fuel composition of claim 1 wherein the chelate of cerium (IV) is ceric 3,5-octanedionate.

5. The gasoline motor fuel composition of claim 1 wherein the chelate of cerium (IV) is ceric 2,2-dimethyl-3,5-heptanedionate.

6. The gasoline motor fuel composition of claim 1 wherein the chelate of cerium (IV) is ceric 2,6-dimethyl-3,5-heptanedionate.

7. The gasoline motor fuel composition of claim 1 wherein the chelate of cerium (IV) is ceric 2,2,6,6-tetramethyl-3,5-heptanedionate.

8. A fuel composition consisting essentially of a gasoline and a knock-inhibiting amount of a β-ketoenolate having the following general formula:

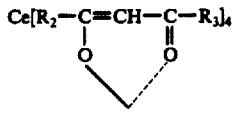

where $R_2$ and $R_3$ are selected from the group consisting of alkyl, aryl and cycloalkyl radicals containing from 1 to 12 carbon atoms and the sum of the carbon atoms in said radicals is 3 to 24.

9. The fuel composition of claim 8 in which the β-ketoenolate is tetrakis(2,2,6,6-tetramethyl-3,5-heptanedionato)cerium(IV).

10. The fuel composition of claim 8 in which the amount of β-ketoenolate is in the range of about 0.71 to 21.4 millimols per gallon of gasoline.

11. The fuel composition of claim 10 which contains an alkyllead.

12. The fuel composition of claim 11 in which the alkyllead is tetraethyllead.

13. In a method of operating an internal combustion in which unburned hydrocarbons are present in the combustion products, the improvement which comprises catalyzing the oxidation of the unburned hydrocarbons by contacting same with a β-ketoenolate having the following general formula:

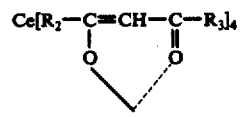

where $R_2$ and $R_3$ are selected from the group consisting of alkyl, aryl and cycloalkyl radicals containing from 1 to 12 carbon atoms and the sum of the carbon atoms in said radicals is 3 to 24.

* * * * *